US011286538B2

(12) United States Patent
Takenaka et al.

(10) Patent No.: US 11,286,538 B2
(45) **Date of Patent: *Mar. 29, 2022**

(54) METHOD FOR MANUFACTURING GRAIN-ORIENTED ELECTRICAL STEEL SHEET

(71) Applicant: JFE STEEL CORPORATION, Tokyo (JP)

(72) Inventors: Masanori Takenaka, Tokyo (JP); Takeshi Imamura, Tokyo (JP); Yuiko Ehashi, Tokyo (JP); Hiroi Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 137 days.

This patent is subject to a terminal disclaimer.

(21) Appl. No.: 16/483,860

(22) PCT Filed: Feb. 19, 2018

(86) PCT No.: PCT/JP2018/005761
§ 371 (c)(1),
(2) Date: Aug. 6, 2019

(87) PCT Pub. No.: WO2018/151296
PCT Pub. Date: Aug. 23, 2018

(65) Prior Publication Data

US 2020/0040419 A1 Feb. 6, 2020

(30) Foreign Application Priority Data

Feb. 20, 2017 (JP) ..... JP2017-028836

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 9/46; C22C 38/04
(Continued)

(56) References Cited

U.S. PATENT DOCUMENTS 2,965,526 A 12/1960 Wiener
4,478,653 A 10/1984 Littmann
(Continued)

FOREIGN PATENT DOCUMENTS

CN 102906283 A 1/2013
EP 3536814 A1 9/2019
(Continued)

OTHER PUBLICATIONS

Dec. 6, 2019, the Extended European Search Report issued by the European Patent Office in the corresponding European Patent Application No. 18755029.8.
(Continued)

*Primary Examiner* — Weiping Zhu
(74) *Attorney, Agent, or Firm* — Kenja IP Law PC

(57) ABSTRACT

In a grain-oriented electrical steel sheet which is manufactured from a thin slab without using an inhibitor forming component, excellent magnetic properties are stably achieved. In a method for manufacturing a grain-oriented electrical steel sheet, a slab heating and annealing are performed under specific conditions.

8 Claims, 3 Drawing Sheets

(51) Int. Cl.

| | |
|---|---|
| ***C21D 8/00*** | (2006.01) |
| ***C21D 8/12*** | (2006.01) |
| ***C22C 38/00*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/34*** | (2006.01) |
| ***C22C 38/54*** | (2006.01) |
| ***H01F 1/147*** | (2006.01) |

(52) U.S. Cl.
CPC ..... *C21D 8/005* (2013.01); *C21D 8/1272* (2013.01); *C22C 38/001* (2013.01); *C22C 38/002* (2013.01); *C22C 38/008* (2013.01); *C22C 38/04* (2013.01); *C22C 38/06* (2013.01); *C22C 38/20* (2013.01); *C22C 38/22* (2013.01); *C22C 38/34* (2013.01); *C22C 38/54* (2013.01); *H01F 1/147* (2013.01); *C22C 2202/02* (2013.01)

(58) Field of Classification Search
USPC ..... 148/111
See application file for complete search history.

(56) References Cited

U.S. PATENT DOCUMENTS

| | | | |
|---|---|---|---|
| 5,330,586 | A | 7/1994 | Komatsubara et al. |
| 6,296,719 | B1 | 10/2001 | Fortunati et al. |
| 6,309,473 | B1 | 10/2001 | Hayakawa et al. |
| 7,371,291 | B2 | 5/2008 | Hayakawa et al. |
| 8,778,095 | B2 | 7/2014 | Isao et al. |
| 8,784,995 | B2 | 7/2014 | Omura et al. |
| 8,871,035 | B2 | 10/2014 | Fortunati et al. |
| 9,187,798 | B2 | 11/2015 | Takenaka et al. |
| 9,617,616 | B2 | 4/2017 | Imamura et al. |
| 9,708,682 | B2 | 7/2017 | Hayakawa et al. |
| 2002/0059966 | A1 | 5/2002 | Hayakawa et al. |
| 2003/0116236 | A1 | 6/2003 | Hayakawa et al. |
| 2004/0239013 | A1 | 12/2004 | Bodin et al. |
| 2009/0199935 | A1 | 8/2009 | Sakakura et al. |
| 2012/0222777 | A1 | 9/2012 | Fortunati et al. |
| 2018/0037966 | A1 | 2/2018 | Hayakawa et al. |
| 2019/0055619 | A1* | 2/2019 | Imamura ..... C22C 38/06 |
| 2019/0256938 | A1 | 8/2019 | Takenaka et al. |
| 2019/0323100 | A1* | 10/2019 | Imamura ..... B22D 11/001 |

FOREIGN PATENT DOCUMENTS

| | | | | |
|---|---|---|---|---|
| JP | H05105956 | A | | 4/1993 |
| JP | 2000129356 | A | | 5/2000 |
| JP | 2001303214 | A | | 10/2001 |
| JP | 2002212639 | A | | 7/2002 |
| JP | 2008031495 | A | | 2/2008 |
| JP | 2008069391 | A | | 3/2008 |
| JP | 2013512332 | A | | 4/2013 |
| JP | 2015200002 | A | * | 11/2015 |
| WO | 9846802 | A1 | | 10/1998 |
| WO | 2010057913 | A1 | | 5/2010 |
| WO | 2016129015 | A1 | | 8/2016 |

OTHER PUBLICATIONS

Klaus Günther et al., Recent Technology Developments in the Production of Grain-Oriented Electrical Steel, steel research international, 2005, pp. 413-421, vol. 76, No. 6.

May 22, 2018, International Search Report issued in the International Patent Application No. PCT/2018/005761.

Jul. 2, 2020, Office Action issued by the China National Intellectual Property Administration in the corresponding Chinese Patent Application No. 201880011415.5 with English language search report.

Mar. 8, 2021, Office Action issued by the China National Intellectual Property Administration in the corresponding Chinese Patent Application No. 201880011415.5 with English language search report.

Fengxi Lu, Foreign cold-rolled silicon steel production technology, 2013, p. 77, Metallurgical Industry Press.

* cited by examiner

METHOD FOR MANUFACTURING GRAIN-ORIENTED ELECTRICAL STEEL SHEET

TECHNICAL FIELD

This disclosure relates to a method for manufacturing a grain-oriented electrical steel sheet.

BACKGROUND

In manufacturing a grain-oriented electrical steel sheet, precipitates called inhibitors are generally used to cause secondary recrystallization of Goss-oriented crystal grains during purification annealing. Recrystallized grains can be stably developed by using inhibitors.

Inhibitors, however, are required to be dispersed finely in steel in order to function. To do so, a steel slab has to be heated to a high temperature of more than 1300° C. during heating prior to hot rolling to dissolve once an inhibitor forming component in the steel. Further, inhibitors which remain in a finally obtained grain-oriented electrical steel sheet could degrade the magnetic properties of the grain-oriented electrical steel sheet. Therefore, purification annealing has to be performed in a high temperature of 1100° C. or more in a controlled atmosphere after secondary recrystallization to remove inhibitors from a steel substrate.

In recent years, for cost reduction, a technique has been developed to make a slab thickness thinner and directly perform hot rolling. As mentioned above, however, for using inhibitors, a slab has to be heated at a high temperature prior to hot rolling to dissolve inhibitors again. A method for directly performing hot rolling cannot heat a slab to a sufficiently high temperature, even though the slab is heated during conveyance prior to hot rolling. To overcome the problem, JP 2002-212639 A (PTL 1) suggests a method for using inhibitors comprising small amounts of MnS and MnSe only, by removing Al as much as possible.

On the other hand, JP 2000-129356 A (PTL 2) suggests a technique of developing Goss-oriented crystal grains without containing an inhibitor forming component. This technique can eliminate impurities such as an inhibitor component as much as possible to thereby elicit the dependency of grain boundary energy of primary recrystallized grain boundaries on the grain boundary misorientation angle, thus causing the secondary recrystallization of the Goss-oriented crystal grains without using inhibitors. The effect of thus inhibiting recrystallization of a texture is called a texture inhibition effect.

The technique does not use inhibitors, thus not requiring purification annealing at a high temperature after secondary recrystallization annealing. In addition, the technique does not require inhibitors to be dispersed finely in steel in advance, thus not requiring steel slab heating at a high temperature. Therefore, the technique without using inhibitors has a considerable advantage in terms of cost performance and maintenance performance. Further, the technique does not need slab heating at a high temperature, and thus can be advantageously applied to a technique of making a thin slab and directly subjecting it to hot rolling.

CITATION LIST

Patent Literatures

PTL 1: JP 2002-212639 A
PTL 2: JP 2000-129356 A

SUMMARY

Technical Problem

As mentioned above, the technique for manufacturing a grain-oriented electrical steel sheet without using an inhibitor forming component is expected to be compatible with a manufacturing technique using a thin slab for cost reduction. Combining these manufacturing techniques with each other to manufacture a grain-oriented electrical steel sheet, however, caused a new problem of magnetic degradation.

It could thus be helpful to stably obtain a grain-oriented electrical steel sheet with excellent magnetic properties in a method for manufacturing a grain-oriented electrical steel sheet from a thin slab without using an inhibitor forming component.

Solution to Problem

We made intensive studies to newly discovered that good magnetic properties can be stably achieved even in a grain-oriented electrical steel sheet manufactured from a thin slab without using an inhibitor forming component by controlling a temperature and a time in a heating process prior to hot rolling, and a heating rate and a soaking temperature of first annealing after hot rolling. The following describes the experiments that led to the disclosure.

Experiment

In order to determine the influence of slab heating conditions on magnetic properties of a grain-oriented electrical steel sheet, grain-oriented electrical steel sheets were manufactured according to the following steps to evaluate magnetic properties of the obtained grain-oriented electrical steel sheets.

First, molten steel was prepared having a chemical composition consisting of, in mass %, C: 0.019%,
Si: 3.26%,
Mn: 0.050%,
sol.Al: 0.0027%,
N: 0.0018%,
S: 0.0015% with the balance being Fe and inevitable impurities. The Se content in the molten steel was smaller than the detection limit. A slab (thin slab) with a thickness of 50 mm was manufactured by continuous casting from the molten steel. The slab was then heated and subsequently subjected to hot rolling to obtain hot-rolled steel sheets with a thickness of 2.6 mm. The slab heating was performed by passing the thin slab through a tunnel furnace while conveying the slab to the hot rolling step. The slab was heated while both of a heating temperature and a heating time were variously changed in the slab heating. The hot rolling was started about 30 seconds after the slab heating was completed.

Then, the obtained hot-rolled steel sheets were subjected to hot band annealing under conditions of a soaking temperature of 1000° C. and a soaking time of 30 seconds. A time to reach 900° C. from 400° C. in a heating process of the hot band annealing was 50 seconds, 100 seconds, or 150 seconds. After the hot band annealing, the hot-rolled steel sheets were subjected to cold rolling to obtain cold-rolled steel sheets with a final sheet thickness of 0.27 mm.

Then, the obtained cold-rolled steel sheets were subjected to primary recrystallization annealing, which also served as decarburization. The primary recrystallization annealing was performed at a soaking temperature of 850° C. for a soaking time of 60 seconds in an atmosphere of 50% $H_2$+50% $N_2$ with a dew point of 50° C. The steel sheets after the primary recrystallization annealing were applied, on their surfaces, with an annealing separator mainly containing MgO, and then were subjected to secondary recrystallization annealing, which also served as purification annealing, in which the steel sheets were retained at 1200° C. for 50 hours in a $H_2$ atmosphere.

Then, the steel sheets after the secondary recrystallization annealing were applied, on their surfaces, with a treatment solution for tension-applying coating mainly containing magnesium phosphate and chromic acid. Subsequently, the steel sheets were subjected to flattening annealing, which also served as baking of the tension-applying coating, at 800° C. for 15 seconds. The above-mentioned steps produced grain-oriented electrical steel sheets with a tension-applying coating on their surfaces.

The magnetic flux density $B_8$ of the obtained grain-oriented electrical steel sheets was measured according to the method described in JIS C2550. The relationship between the measured magnetic flux density $B_8$ and the slab heating conditions (heating temperature and heating time) is illustrated in FIG. 1 to FIG. 3. FIG. 1, FIG. 2, and FIG. 3 each illustrate a result from cases where a time to reach 900° C. from 400° C. in the heating process of the hot band annealing was 50 seconds, 100 seconds, or 150 seconds, respectively.

It can be seen from the results illustrated in FIG. 1 to FIG. 3 that high magnetic flux density is achieved by setting, in the slab heating, the heating temperature to 1000° C. or more and 1300° C. or less and the heating time to 60 seconds or more and 600 seconds or less. Further, it can be seen that higher magnetic flux density is achieved by setting the time to reach 900° C. from 400° C. in the heating process of the hot band annealing to 100 seconds or less, in addition to satisfying the slab heating conditions.

Although the mechanism has not been necessarily clarified by which the heating temperature and the heating time in the slab heating, and the heating rate and the soaking temperature in the first annealing after the hot rolling thus affect magnetic properties, we consider as follows.

Features of a thin slab include its slab texture being mainly composed of columnar crystals. This is considered to be because in manufacturing a thin slab, the slab is cooled rapidly during casting as compared with a thick slab and has a larger temperature gradient at interfaces of solidified shells, and thus equiaxial crystals are less likely to occur from a center part in a sheet thickness direction. When a slab having columnar crystal texture is hot rolled, hot rolling processed texture occurs which is less likely to be recrystallized even in subsequent heat treatment. The hot rolling processed texture inhibits recrystallization, thus degrading magnetic properties of a finally obtained grain-oriented electrical steel sheet. That is, the slab texture mainly comprising columnar crystals prior to hot rolling is presumed to cause magnetic degradation.

Solving this problem requires columnar crystallites to be reduced. Manufacturing typical steel products except electrical steel sheets involves α(ferrite)-γ(austenite) transformation so that even in columnar crystallites which have been formed in a high temperature range of the α-phase, recrystallization with transformation occurs in a temperature range of the γ-phase, thus reducing the columnar crystallites. However, a grain-oriented electrical steel sheet has significantly low proportion of the γ-phase to prevent the γ-transformation after secondary recrystallization from destroying Goss-oriented grain texture, and thus may have an a single-phase microstructure in some cases. Therefore, it is difficult to reduce columnar crystallites by the recrystallization with transformation in the temperature range of the γ-phase.

Then, we have focused on another feature in thin slab manufacture, i.e., strain accumulated within the texture of a thin slab. In regular continuous casting, a slab is casted in a vertical direction and then adjusted so that it turns approximately 90° with a certain curvature to be conveyed in a horizontal direction. In manufacturing a regular slab with a thickness of about 200 mm, the slab is not easily deformed, thus having a small amount of curvature. However, a thin slab with a thin thickness is easy to be bent; therefore, the curvature in the adjustment is increased to reduce a space required for the bending adjustment, thus reducing the manufacturing cost. As the result, a thin slab has a considerable degree of strain accumulated in its texture.

A thin slab having such accumulated strain is subjected to heat treatment at a somewhat high temperature to thereby induce partial strain-induced grain growth or recrystallization of texture different from columnar crystals (equiaxial crystals). As the result, columnar crystallites in the slab are reduced and thus magnetic properties of a product sheet are believed to be improved. This phenomenon does not occur in a typical steel product involving the α-γ transformation, because even if strain is accumulated, the strain is released upon transformation. That is, the phenomenon is believed to be peculiar to a steel sample such as a grain-oriented electrical steel sheet which mainly having an a phase.

In addition, in slab heating, either when the heating temperature is excessively high such as when it exceeds 1300° C. or when the heating time is excessively long such as when it exceeds 600 seconds, excessively coarse crystal grains are generated instead of columnar crystallites. As the result, it is believed that texture similar to columnar crystallites is generated which is not easily recrystallized even with heat treatment, degrading magnetic properties of a product sheet.

When a thin slab is hot rolled to manufacture a hot-rolled steel sheet, the total rolling reduction in hot rolling is reduced as compared with when a slab with a typical thickness is hot rolled to manufacture a hot-rolled steel sheet. Therefore, a thin slab has reduced strain accumulated in hot rolling, being less likely to cause recrystallization during hot band annealing. As the result, using a thin slab is problematic in that non-recrystallized parts remain in a steel sheet after hot band annealing. The remaining non-recrystallized parts degrade magnetic properties in a finally obtained grain-oriented electrical steel sheet. As mentioned above, the problem can be solved by setting the soaking temperature in hot band annealing to 950° C. or more and raising the temperature rapidly to around the soaking temperature. That is, the temperature can be raised rapidly to around the soaking temperature to thereby reach a temperature which makes recrystallization possible without excessively consuming a relatively less strain accumulated during hot rolling. As the result, it is believed that a recrystallization ratio of a hot band-annealed sheet can be dramatically increased, thus further increasing magnetic properties.

A method for solving the problem of columnar crystallites of a thin slab includes installing new facilities with a function to achieve equiaxial crystallization of texture. However, the installation of such facilities has a demerit of significant increase in cost. The disclosure can improve magnetic properties of a grain-oriented electrical steel sheet by successfully combining the texture feature of a grain-oriented electrical steel sheet with the feature of thin slab continuous casting while preventing as much as possible cost increase such as new facilities installation.

As mentioned above, we succeeded in preventing magnetic properties degradation in an inhibitorless material by controlling, in manufacturing a grain-oriented electrical steel sheet from a thin slab, the heating temperature and the heating time in slab heating, and the heating rate and the soaking temperature of first annealing performed after hot rolling.

The disclosure is based on these new findings, and primary features thereof are as described below.

1. A method for manufacturing a grain-oriented electrical steel sheet, comprising:

subjecting molten steel to continuous casting to form a slab with a thickness of 25 mm or more and 100 mm or less, the molten steel having a chemical composition containing (consisting of), in mass %, C: 0.002% or more and 0.100% or less, Si: 2.00% or more and 8.00% or less, Mn: 0.005% or more and 1.000% or less, sol.Al: less than 0.0100%, N: less than 0.0060%, S: less than 0.0100%, and Se: less than 0.0100%, with the balance being Fe and inevitable impurities;

heating the slab;

hot rolling the heated slab to obtain a hot-rolled steel sheet;

optionally subjecting the hot-rolled steel sheet to hot band annealing;

subjecting the hot-rolled steel sheet to cold rolling to obtain a cold-rolled steel sheet with a final sheet thickness;

subjecting the cold-rolled steel sheet to primary recrystallization annealing; and subjecting the cold-rolled steel sheet after the primary recrystallization annealing to secondary recrystallization annealing, wherein in the heating of the slab, a heating temperature is 1000° C. or more and 1300° C. or less and a heating time is 60 seconds or more and 600 seconds or less, wherein (i) when the hot band annealing is performed, a time to reach 900° C. from 400° C. in a heating process of the hot band annealing is 100 seconds or less, and a soaking temperature in the hot band annealing is 950° C. or more, and wherein (ii) when the hot band annealing is not performed, the cold rolling has two or more rolling operations with intermediate annealing performed therebetween, a time to reach 900° C. from 400° C. in a heating process of the first intermediate annealing is 100 seconds or less, and a soaking temperature in the first intermediate annealing is 950° C. or more.

2. The method for manufacturing a grain-oriented electrical steel sheet according to 1., wherein in the heating of the slab, the slab is heated while being conveyed to a casting direction at a rate of 10 m/min or more.

3. The method for manufacturing a grain-oriented electrical steel sheet according to 1. or 2., wherein the chemical composition contains, in mass %, S: less than 0.0030%, and Se: less than 0.0030%.

4. The method for manufacturing a grain-oriented electrical steel sheet according to any one of 1. to 3., wherein the chemical composition further contains, in mass %, one or more selected from the group consisting of Cr: 0.01% or more and 0.50% or less, Cu: 0.01% or more and 0.50% or less, P: 0.005% or more and 0.50% or less, Ni: 0.001% or more and 0.50% or less, Sb: 0.005% or more and 0.50% or less, Sn: 0.005% or more and 0.50% or less, Bi: 0.005% or more and 0.50% or less, Mo: 0.005% or more and 0.100% or less, B: 0.0002% or more and 0.0025% or less, Nb: 0.0010% or more and 0.0100% or less, and V: 0.0010% or more and 0.0100% or less.

5. The method for manufacturing a grain-oriented electrical steel sheet according to any one of 1. to 4., wherein the heating of the slab is at least partially performed by induction heating.

Advantageous Effect

According to the disclosure, a grain-oriented electrical steel sheet manufactured from a thin slab without using an inhibitor forming component can stably achieve excellent magnetic properties.

DETAILED DESCRIPTION

[Chemical Composition]

Figure 1:
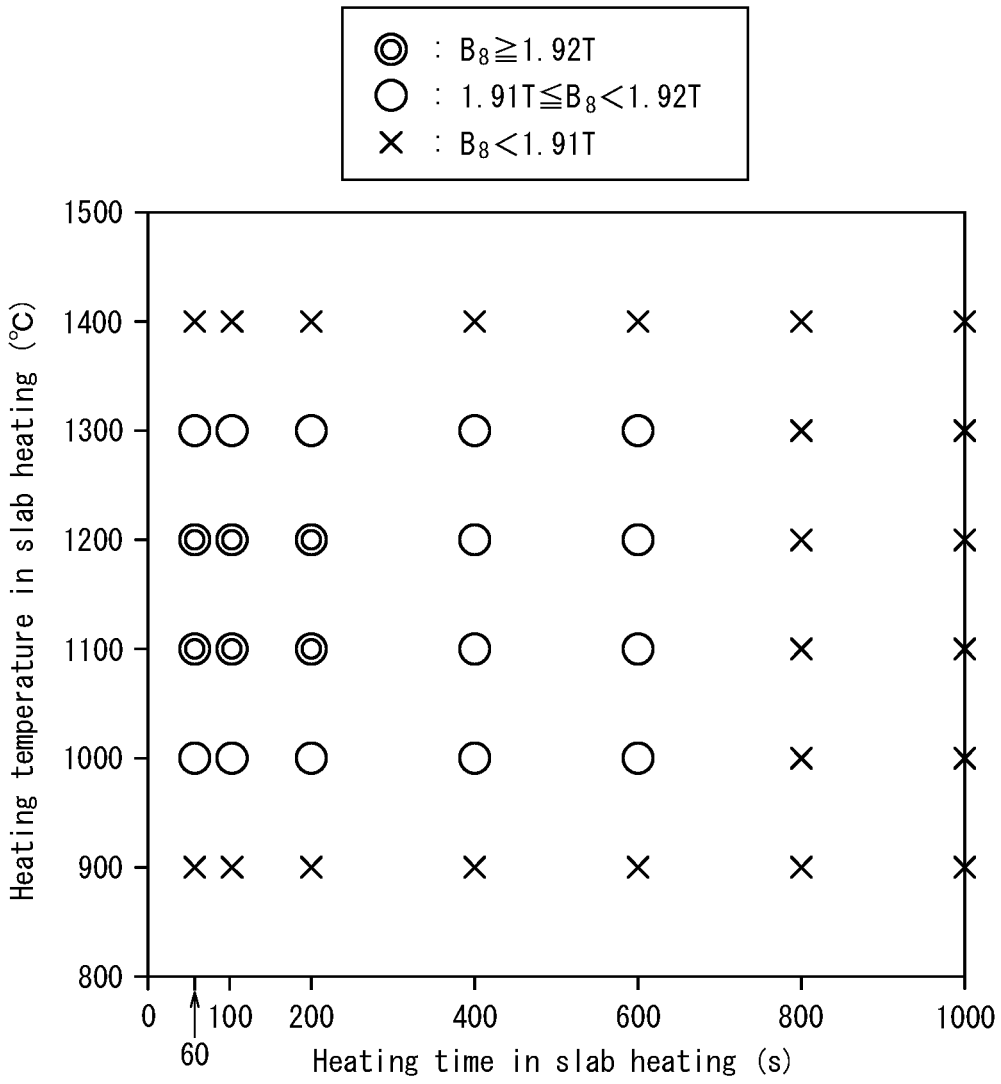
FIG. 1 illustrates a graph presenting a relationship among a heating temperature, a heating time, and the magnetic flux density $B_8$ in slab heating when a time to reach 900° C. from 400° C. in a heating process of hot band annealing is 50 seconds.
Figure 2:
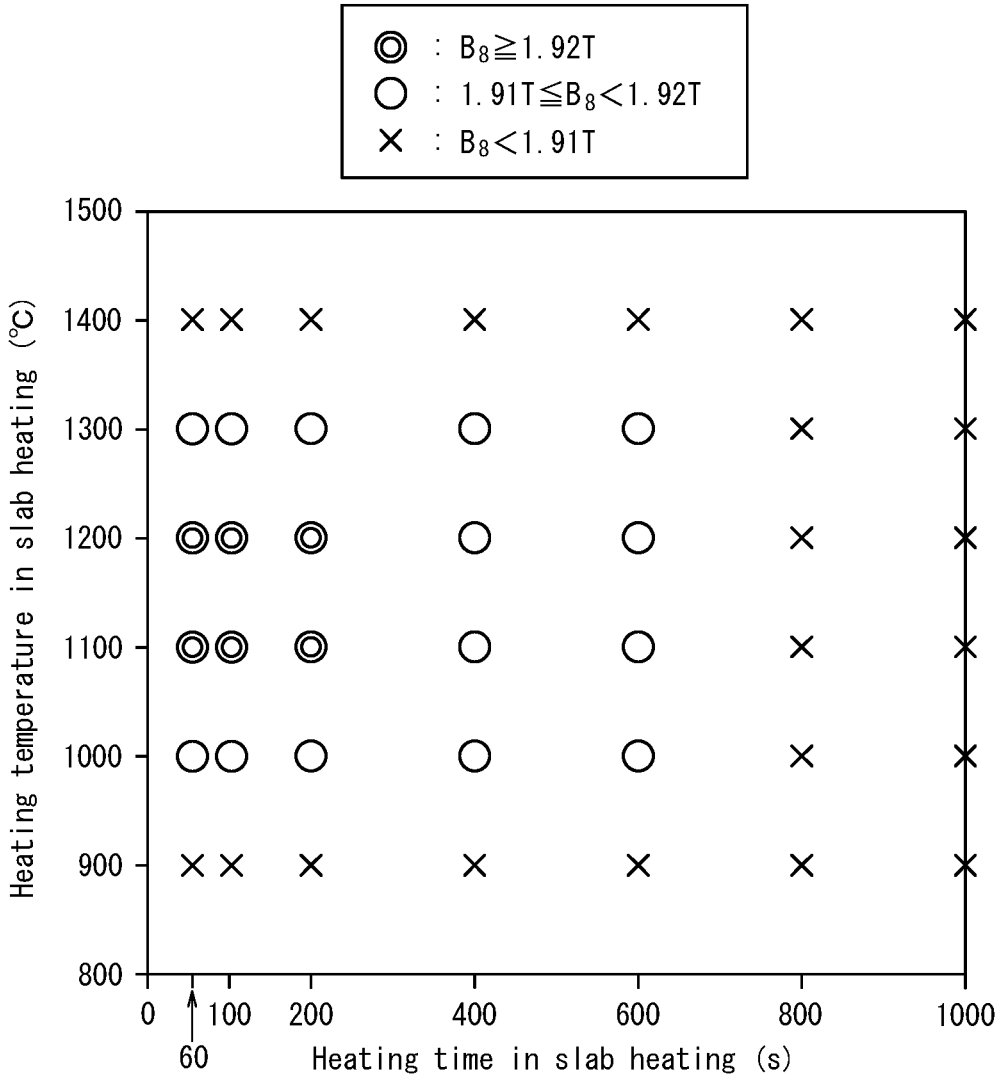
FIG. 2 illustrates a graph presenting a relationship among a heating temperature, a heating time, and the magnetic flux density $B_8$ in slab heating when a time to reach 900° C. from 400° C. in a heating process of hot band annealing is 100 seconds.
Figure 3:
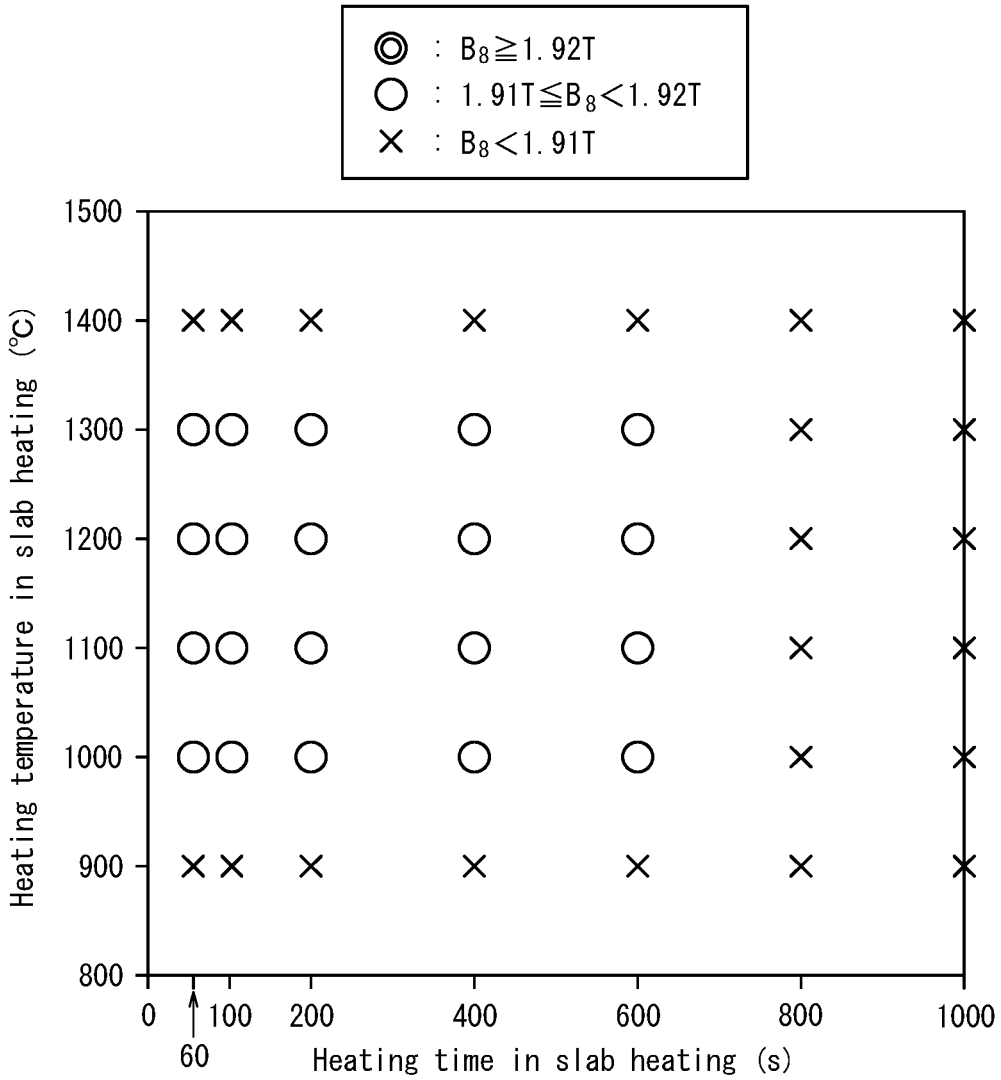
FIG. 3 illustrates a graph presenting a relationship among a heating temperature, a heating time, and the magnetic flux density $B_8$ in slab heating when a time to reach 900° C. from 400° C. in a heating process of hot band annealing is 150 seconds.

A method for manufacturing a grain-oriented electrical steel sheet according to one of the disclosed embodiments is described below. The reasons for limiting the chemical composition of molten steel used for manufacturing a steel slab are described first. The chemical composition of a steel slab obtained by continuous casting is basically the same as the chemical composition of used molten steel. When a content of each component is expressed in "%", this refers to "mass %" unless otherwise specified.

C: 0.002% or More and 0.100% or Less

If the C content is less than 0.002 mass %, the grain boundary strengthening effect by C is poor, and defects, such as slab cracking, appear, which hamper manufacture. Accordingly, the C content is 0.002% or more, and preferably 0.010% or more. On the other hand, C degrades magnetic properties due to magnetic aging. Therefore, in manufacturing the grain-oriented electrical steel sheet, the C content is preferably reduced in the grain-oriented electrical steel sheet finally obtained after decarburization annealing. However, if the C content of molten steel exceeds 0.100%, it is difficult to reduce, by decarburization annealing, the content to 0.005% or less which causes no magnetic aging. Accordingly, the C content of molten steel is 0.100% or less and preferably 0.050% or less. For the above-mentioned reason, the C content of the finally obtained grain-oriented electrical steel sheet is preferably 0.005% or less.

Si: 2.00% or More and 8.00% or Less

Si is an element necessary to increase the specific resistance of steel and reduce iron loss. If the Si content is less than 2.00%, however, the effect cannot be achieved. Thus, the Si content is 2.00% or more, and preferably 2.50% or more. If the Si content exceeds 8.0%, steel workability is reduced to make rolling difficult. Accordingly, the Si content is 8.00% or less, and preferably 4.50% or less.

Mn: 0.005% or More and 1.000% or Less

Mn is an element necessary to improve hot workability. If the Mn content is less than 0.005%, however, the effect cannot be achieved. Thus, the Mn content is 0.005% or more, and preferably 0.040% or more. If the Mn content exceeds 1.000%, the magnetic flux density of the finally obtained grain-oriented electrical steel sheet is reduced. Accordingly, the Mn content is 1.000% or less, and preferably 0.200% or less.

Sol.Al: Less than 0.0100%

Al is an inhibitor forming component. The disclosure is based on an inhibitorless method. Thus, the sol.Al content needs to be reduced as much as possible. Accordingly, the sol.Al content is less than 0.0100% and preferably less than 0.0070%. The lower limit of the sol.Al content is not particularly limited, and may be 0%, or from an industrial point of view, may be more than 0%. An excessive reduction of the sol.Al content results in an increase in manufacturing costs. Accordingly, the sol.Al content is preferably 0.0005% or more.

N: Less than 0.0060%

N is also an inhibitor forming component. Thus, the N content is less than 0.0060%, and preferably less than 0.0040%. The lower limit of the N content is not particularly limited, and may be 0%, or from an industrial point of view, may be more than 0%. An excessive reduction of the N content results in an increase in manufacturing costs. Accordingly, the N content is preferably 0.001% or more.

S: Less than 0.0100%

S is also an inhibitor forming component. Thus, the S content is less than 0.0100% and preferably less than 0.0030%. The lower limit of the S content is not particularly limited, and may be 0%, or from an industrial point of view, may be more than 0%. An excessive reduction of the S content results in an increase in manufacturing costs. Accordingly, the S content is preferably 0.001% or more.

Se: Less than 0.0100%

Se is also an inhibitor forming component. Accordingly, the Se content is less than 0.0100% and preferably less than 0.0030%. The lower limit of the Se content is not particularly limited, and may be 0%, or from an industrial point of view, may be more than 0%.

In one of the disclosed embodiments, molten steel can be used which has a chemical composition containing (consisting of) the above-mentioned elements and the balance being Fe and inevitable impurities. Examples of the inevitable impurities include impurities inevitably mixed from raw materials, manufacturing facilities, and the like into steel.

In other embodiments of the disclosure, the chemical composition can further optionally contain one or more selected from the group consisting of Cr: 0.01% or more and 0.50% or less, Cu: 0.01% or more and 0.50% or less, P: 0.005% or more and 0.50% or less, Ni: 0.001% or more and 0.50% or less, Sb: 0.005% or more and 0.50% or less, Sn: 0.005% or more and 0.50% or less, Bi: 0.005% or more and 0.50% or less, Mo: 0.005% or more and 0.100% or less, B: 0.0002% or more and 0.0025% or less, Nb: 0.0010% or more and 0.0100% or less, and V: 0.0010% or more and 0.0100% or less. When the chemical composition further contains at least one of these elements, the grain-oriented electrical steel sheet can have further improved magnetic properties. However, if the contents of these elements are lower than the respective lower limits described above, the magnetic properties-improving effect is limited. If the contents of these elements exceed the respective upper limits described above, the growth of secondary recrystallized grains is inhibited, degrading magnetic properties.

The following describes a method for manufacturing a grain-oriented electrical steel sheet according to the disclosure.

[Continuous Casting]

First, molten steel having the above-mentioned chemical composition is subjected to thin slab continuous casting to form a slab. The thickness of the continuously-cast slab is the continuously-cast steel is 25 mm or more and 100 mm or less for cost reduction. The thickness of the slab is preferably 40 mm or more. The thickness of the slab is preferably 80 mm or less.

[Heating]

The slab manufactured from the molten steel is heated in a heating process prior to hot rolling. The heating is also referred to as slab heating. As mentioned above, the disclosure does not need annealing at a high temperature for a long time for dissolving inhibitors, and thus, in the slab heating, the heating temperature is 1000° C. or more and 1300° C. or less and the heating time is 60 seconds or more and 600 seconds or less. To further reduce manufacturing costs, the heating temperature is preferably 1250° C. or less. Similarly, to further reduce manufacturing costs, the heating time is preferably 400 seconds or less. To further improve magnetic properties, the heating temperature is preferably 1100° C. or more and 1200° C. or less. Similarly, to further improve magnetic properties, the heating time is preferably 200 seconds or more and 400 seconds or less. As used herein, the heating time refers to a residence time in a temperature range of 1000° C. or more and 1300° C. or less in a process of from temperature increase to temperature decrease during the heating.

The slab is heated in any facilities, but preferably heated using a tunnel furnace. The tunnel furnace is facilities in which a conveyance table is integrated with a heating furnace. By using the tunnel furnace, the slab can be heated and retained during conveyance, and thus temperature variations in the slab can be inhibited. The slab is typically heated in a walking beam furnace with skids. By using the tunnel furnace instead to heat the slab, it is possible to manufacture a grain-oriented electrical steel sheet with more excellent properties without magnetic properties degradation due to slab "drooping" and decrease in temperature of the skids that would occur in the walking beam furnace. Further, in the tunnel furnace, the slab is heated while being conveyed in parallel to a casting direction. At that time, the slab is conveyed on table rolls. Accordingly, to prevent surface defects caused by the "drooping" from between the rolls and decrease in temperature of the slab due to the contact with the rolls, the conveyance rate of the slab in the tunnel furnace is preferably 10 m/min or more.

A method to heat the slab is not particularly limited, but the slab heating is at least partially performed by induction heating. The induction heating is a method to heat a slab by self-heating, for example, by applying an alternating magnetic field to the slab.

[Hot Rolling]

After the heating, hot rolling is performed. The hot rolling can be performed under any conditions. The hot rolling can comprise rough rolling and finish rolling. However, given that a thin slab is used, hot rolling which comprises finish rolling by a tandem mill only with no rough rolling is preferably used for manufacturing cost reduction.

The hot rolling can be performed under any conditions. To further improve the magnetic properties of the finally obtained grain-oriented electrical steel sheet, the hot rolling preferably has a start temperature of 900° C. or more and a finish temperature of 700° C. or more. On the other hand, to further improve a steel sheet shape after rolling, the finish temperature is preferably 1000° C. or less. To inhibit temperature variations in the steel sheet, a time from completion of the slab heating to start of the hot rolling is preferably 100 seconds or less.

[Hot Band Annealing]

After the hot rolling, hot band annealing is optionally performed. In other words, hot band annealing may be performed and may not be performed. When hot band annealing is performed, the hot-rolled steel sheet is subjected to hot band annealing to obtain an annealed sheet. The annealed sheet is then cold rolled. When hot band annealing is not performed, the hot-rolled steel sheet is cold rolled.

When the hot band annealing is performed, a time to reach 900° C. from 400° C. in a heating process of the hot band annealing is 100 seconds or less. A soaking temperature in the hot band annealing is 950° C. or more. The satisfaction of the above-mentioned conditions makes it possible to obtain good magnetic properties. If the above-mentioned conditions are not satisfied, band texture which has been formed during hot rolling would remain even after hot band annealing. As the result, the primary recrystallized texture of uniformly sized-grains cannot be obtained and thus the development of secondary recrystallization is inhibited.

No upper limit is placed on the soaking temperature, but the soaking temperature is preferably 1150° C. or less. By setting the soaking temperature to 1150° C. or less, excessively coarsening of crystal grains in hot band annealing is prevented, and thus the primary recrystallized texture of uniformly-sized grains are more effectively achieved. The soaking temperature is more preferably 1080° C. or less.

A soaking time in the hot band annealing is not particularly limited, and may be arbitrarily determined. However, when the soaking time is 10 seconds or more, it is possible to more effectively prevent the band texture from remaining. Therefore, the soaking time is preferably 10 seconds or more, and more preferably 15 seconds or more. On the other hand, when the soaking time is 200 seconds or less, it is possible to further prevent segregation of elements into grain boundaries, and thus further prevent the generation of defects during the cold rolling due to grain boundary segregation elements. Therefore, the soaking time is preferably 200 seconds or less, and more preferably 120 seconds or less.

When hot band annealing is not performed, the below-mentioned "first intermediate annealing", instead of the hot band annealing, needs to satisfy the annealing conditions.

[Cold Rolling]

The steel sheet is then cold rolled to obtain a cold-rolled steel sheet. The cold rolling may comprise only one rolling operation, and may comprise two or more rolling operations with intermediate annealing performed therebetween. For example, when rolling is performed twice, first rolling, intermediate annealing, and second rolling may be performed in sequence. When rolling is performed three times, intermediate annealing is performed between each rolling.

A soaking temperature in the intermediate annealing is preferably 900° C. or more and 1200° C. or less. When the soaking temperature is 900° C. or more, the size of recrystallization grains becomes more suitable, which increases Goss nuclei in primary recrystallized texture to improve magnetic properties. When the soaking temperature is 1200° C. or less, coarsening of grain size is prevented and primary recrystallized texture of uniformly-sized grains can be obtained. The soaking temperature is preferably 1150° C. or less.

In addition, as mentioned above, when the hot band annealing is not performed, it is necessary that the cold rolling comprises two or more rolling operations with intermediate annealing performed therebetween, a time to reach 900° C. from 400° C. in a heating process of the first intermediate annealing is 100 seconds or less, and a soaking temperature in the first intermediate annealing is 950° C. or more.

To change the recrystallized texture to further improve magnetic properties, the cold rolling is preferably performed in a rolling temperature of 100° C. to 300° C. For the same reason, it is preferable to perform aging treatment one or more times in a range of 100° C. to 300° C. As used herein, final cold rolling refers to a rolling operation which is finally performed among rolling operations comprised in the cold rolling process. For example, when the cold rolling comprises only one rolling operation, the rolling is the final cold rolling. When the cold rolling comprises two rolling operations with intermediate annealing performed therebetween, the second rolling is the final cold rolling.

[Primary Recrystallization Annealing]

Then, the cold-rolled steel sheet obtained in the cold rolling process is subjected to primary recrystallization annealing. The primary recrystallization annealing may also serve as decarburization annealing. Conditions of the primary recrystallization annealing is not particularly limited, but in terms of decarburization properties, a soaking temperature is preferably 800° C. or more and 900° C. or less. In terms of decarburization properties, the primary recrystallization annealing is preferably performed in a wet atmosphere. Further, a soaking time is preferably about 30 seconds or more and 300 seconds or less. This, however, does not apply in the case that the C content in the steel slab is 0.005% or less and the decarburization is not necessary.

[Applying of Annealing Separator]

The steel sheet after primary recrystallization annealing is optionally applied with an annealing separator. In the case of forming a forsterite film, placing importance on iron loss, an annealing separator mainly containing MgO is used. The steel sheet applied with an annealing separator mainly containing MgO can be subjected to secondary recrystallization annealing to thereby form a forsterite film on the steel sheet surface.

On the other hand, in the case of not forming a forsterite film, placing importance on blanking workability, secondary recrystallization annealing can be performed without applying an annealing separator. Even if an annealing separator is applied, when an annealing separator not containing MgO is used, a forsterite film is not formed. As the annealing separator not containing MgO, an annealing separator containing one or both of silica and alumina can be used.

A method for applying an annealing separator is not particularly limited, but for example, electrostatic coating is applicable. The electrostatic coating can apply an annealing separator to a steel sheet without introducing water. Further, a method for attaching a heat resistant inorganic material sheet to the surface of a steel sheet can be also used. As the heat resistant inorganic material sheet, a sheet comprising one or more selected from the group consisting of, for example, silica, alumina, and mica can be used.

[Secondary Recrystallization Annealing]

Then, secondary recrystallization annealing is performed. The secondary recrystallization annealing may also serve as purification annealing. The secondary recrystallization annealing is desirably performed at 800° C. or more to develop secondary recrystallization. Further, for completion of the secondary recrystallization, the steel sheet is preferably retained at a temperature of 800° C. or more for 20 hours or more. In the case of not forming a forsterite film, placing importance on blanking workability, the secondary recrystallization only has to be completed; therefore, a soaking temperature is preferably 850° C. or more and 950° C. or less. It is also possible to finish the annealing during the retention in the temperature range. In the case of placing importance on iron loss or in the case of forming a forsterite film to reduce noise from a transformer, it is preferable to raise a temperature to about 1200° C.

[Flattening Annealing]

After the secondary recrystallization annealing, flattening annealing can be performed. The flattening annealing can adjust a shape of the grain-oriented electrical steel sheet, and further reduce iron loss. When an annealing separator is applied in the preceding process, the annealing separator attached to the steel sheet is preferably removed prior to flattening annealing. The annealing separator is preferably removed by one or more selected from the group consisting of, for example, water washing, brushing, and pickling. In the view of shape adjustment, the soaking temperature of the flattening annealing is preferably about 700° C. or more and 900° C. or less.

[Insulating Coating]

In the case of using the steel sheet in a stacked state, it is effective to apply an insulation coating to the steel sheet surface before or after the flattening annealing to improve iron loss. A coating is desirable that imparts tension to the steel sheet for iron loss reduction. It is preferable to adopt coating methods such as a tension coating via a binder, as well as a physical vapor deposition and a chemical vapor deposition to deposit inorganic substances onto the surface layer of the steel sheet. This is because insulating coating using these methods enables excellent coating adhesion and produces a significant effect of reducing iron loss.

[Magnetic Domain Refining Treatment]

After the flattening annealing, magnetic domain refining treatment can also be performed for iron loss reduction. The treatment methods include, for example, commonly practiced methods such as forming grooves in a surface of a grain-oriented electrical steel sheet; introducing a linear thermal strain or impact strain by laser irradiation or electron beam irradiation; and forming grooves beforehand in an intermediate product such as a cold-rolled sheet with a final sheet thickness.

The other manufacturing conditions may comply with typical grain-oriented electrical steel sheet manufacturing methods.

EXAMPLES

Example 1

Grain-oriented electrical steel sheets were manufactured in the below-mentioned procedures, and the grain-oriented electrical steel sheets thus obtained were evaluated for magnetic properties.

First, molten steel was prepared having a chemical composition consisting of, in mass %, C: 0.014%,
Si: 3.41%,
Mn: 0.060%,
sol.Al: 0.0031%,
N: 0.0016%,
S: 0.0012%, Sb: 0.090% with the balance being Fe and inevitable impurities. The Se content in the molten steel was smaller than the detection limit. From the molten steel, a slab with a thickness of 30 mm was manufactured by continuous casting.

The obtained slab was heated under conditions as listed in Table 1. The slab was heated using a tunnel furnace of the regenerative burner heating type. A slab conveyance rate in the heating process in the tunnel furnace was varied according to the heating time.

60 seconds after completion of the heating treatment, hot rolling was started to obtain hot-rolled steel sheets with a thickness of 2.2 mm. Then, the obtained hot-rolled steel sheets were subjected to hot band annealing. A time to reach 900° C. from 400° C. in the heating process of the hot band annealing was set as listed in Table 1. In the hot band annealing, the soaking temperature was 975° C. and the soaking time was 60 seconds.

The hot-rolled steel sheets after hot band annealing were then subjected to cold rolling. The cold rolling comprised two rolling operations with intermediate annealing performed therebetween. Specifically, first, the hot-rolled steel sheets were subjected to first rolling into a sheet thickness of 1.3 mm, then subjected to intermediate annealing, and subsequently, subjected to second rolling to obtain cold-rolled steel sheets with a final sheet thickness of 0.23 mm. In the intermediate annealing, the soaking temperature was 1000° C. and the soaking time was 100 seconds.

Then, the obtained cold-rolled steel sheets were subjected to primary recrystallization annealing, which also served as decarburization annealing. In the primary recrystallization annealing, the soaking temperature was 840° C. and the soaking time was 100 seconds. The primary recrystallization annealing was performed in an atmosphere of 50% $H_2$+50% $N_2$ with a dew point of 55° C.

Then, the steel sheets after the primary recrystallization annealing were applied, on their surfaces, with an annealing separator mainly containing MgO and then subjected to secondary recrystallization annealing, which also served as purification annealing. In the secondary recrystallization annealing, the steel sheets were retained at 1200° C. for 10 hours in a $H_2$ atmosphere. Subsequently, the steel sheets were applied, on their surfaces, with a treatment solution for tension-applying coating and subjected to flattening annealing, which also served as baking of the tension-applying coating, to form a tension-applying coating mainly containing magnesium phosphate and chromic acid. The flattening annealing was performed at 800° C. for 15 seconds.

The magnetic flux density $B_8$ of the obtained grain-oriented electrical steel sheets was measured by the method described in JIS C2550. The measurement results were presented in Table 1. As is apparent from the results listed in Table 1, the steel sheets satisfying the conditions according to the disclosure have excellent magnetic properties.

TABLE 1

| No. | Slab heating: Heating temperature (° C.) | Slab heating: Heating time (s) | Slab heating: Conveyance rate (m/min) | Heating process in hot band annealing: Time to reach 900° C. from 400° C. (s) | Magnetic flux density $B_8$ (T) | Remarks |
|---|---|---|---|---|---|---|
| 1 | 950 | 600 | 10 | 70 | 1.811 | Comparative Example |
| 2 | 1000 | 40 | 75 | 70 | 1.898 | Comparative Example |
| 3 | 1000 | 60 | 50 | 70 | 1.911 | Example |
| 4 | 1000 | 600 | 10 | 70 | 1.918 | Example |
| 5 | 1000 | 1000 | 6 | 70 | 1.901 | Comparative Example |
| 6 | 1150 | 40 | 150 | 70 | 1.896 | Comparative Example |
| 7 | 1150 | 60 | 100 | 70 | 1.936 | Example |
| 8 | 1150 | 600 | 10 | 70 | 1.914 | Example |
| 9 | 1150 | 1000 | 6 | 70 | 1.887 | Comparative Example |
| 10 | 1300 | 40 | 75 | 70 | 1.874 | Comparative Example |
| 11 | 1300 | 60 | 50 | 70 | 1.918 | Example |
| 12 | 1300 | 600 | 10 | 70 | 1.916 | Example |
| 13 | 1300 | 1000 | 6 | 70 | 1.880 | Comparative Example |
| 14 | 1350 | 600 | 10 | 70 | 1.867 | Comparative Example |
| 15 | 1150 | 100 | 60 | 100 | 1.913 | Example |
| 16 | 950 | 600 | 10 | 120 | 1.792 | Comparative Example |
| 17 | 1000 | 40 | 75 | 120 | 1.877 | Comparative Example |
| 18 | 1000 | 60 | 50 | 120 | 1.891 | Comparative Example |
| 19 | 1000 | 600 | 10 | 120 | 1.902 | Comparative Example |
| 20 | 1000 | 1000 | 6 | 120 | 1.882 | Comparative Example |
| 21 | 1150 | 40 | 75 | 120 | 1.887 | Comparative Example |
| 22 | 1150 | 60 | 50 | 120 | 1.904 | Comparative Example |
| 23 | 1150 | 600 | 10 | 120 | 1.899 | Comparative Example |
| 24 | 1150 | 1000 | 6 | 120 | 1.885 | Comparative Example |
| 25 | 1300 | 40 | 75 | 120 | 1.874 | Comparative Example |
| 26 | 1300 | 60 | 50 | 120 | 1.900 | Comparative Example |
| 27 | 1300 | 600 | 10 | 120 | 1.896 | Comparative Example |
| 28 | 1300 | 1000 | 6 | 120 | 1.871 | Comparative Example |
| 29 | 1350 | 600 | 10 | 120 | 1.805 | Comparative Example |

Example 2

A slab with a thickness of 45 mm was manufactured by continuous casting from molten steel having a chemical composition as listed in Table 2. In the Se column of Table 2, "-" denotes that the Se content was smaller than the detection limit. The obtained slab was heated under conditions of a heating temperature of 1200° C. and a heating time of 120 seconds. The slab heating was performed by passing the slab through a tunnel furnace retained at 1200° C. A slab conveyance rate in the tunnel furnace was 20 m/min. The slab was heated to 700° C. by induction heating, and subsequently, heated and retained using a gas burner.

The heated slab was then hot rolled into hot-rolled steel sheets with a thickness of 2.4 mm. The hot rolling was started 30 seconds after completion of the slab heating.

Then, the hot-rolled steel sheets were subjected to hot band annealing. A time to reach 900° C. from 400° C. in a heating process of the hot band annealing was 50 seconds. In the hot band annealing, the soaking temperature was 1000° C. and the soaking time was 60 seconds. Subsequently, the steel sheets were subjected to cold rolling once to obtain cold-rolled steel sheets with a final sheet thickness of 0.23 mm.

Then, the obtained cold-rolled steel sheets were subjected to primary recrystallization annealing, which also served as decarburization annealing. In the primary recrystallization annealing, the soaking temperature was 820° C. and the soaking time was 100 seconds. The primary recrystallization annealing was performed in an atmosphere of 50% $H_2$+50% $N_2$ with a dew point of 55° C.

Then, the steel sheets after the primary recrystallization annealing were applied, on their surfaces, with an annealing separator mainly containing MgO, and were subjected to secondary recrystallization annealing, which also served as purification annealing. In the secondary recrystallization annealing, the steel sheets were retained at 1200° C. for 10 hours in a $H_2$ atmosphere. Subsequently, the steel sheets were applied, on their surfaces, with a treatment solution for tension-applying coating and subjected to flattening annealing, which also served as baking of the tension-applying coating, to form a tension-applying coating mainly containing magnesium phosphate and chromic acid. The flattening annealing was performed at 850° C. for 10 seconds.

The magnetic flux density $B_8$ of the obtained grain-oriented electrical steel sheets was measured by the method described in JIS C2550. The measurement results were presented in Table 2. As is apparent from the results listed in Table 2, the steel sheets satisfying the conditions according to the disclosure have excellent magnetic properties.

TABLE 2

| No. | Chemical composition (mass %) * | | | | | | | | Magnetic flux density $B_8$ | |
|---|---|---|---|---|---|---|---|---|---|---|
| | C | Si | Mn | sol.Al | N | S | Se | Others | (T) | Remarks |
| 1 | 0.004 | 3.22 | 0.007 | 0.0011 | 0.0009 | 0.0013 | — | — | 1.924 | Example |
| 2 | 0.091 | 4.78 | 0.930 | 0.0088 | 0.0041 | 0.0019 | 0.0089 | — | 1.927 | Example |
| 3 | 0.001 | 2.84 | 0.070 | 0.0031 | 0.0029 | 0.0017 | 0.0044 | — | 1.533 | Comparative Example |
| 4 | 0.119 | 3.06 | 0.060 | 0.0047 | 0.0026 | 0.0071 | — | — | 1.514 | Comparative Example |
| 5 | 0.024 | 1.74 | 0.220 | 0.0019 | 0.0033 | 0.0022 | 0.0027 | — | 1.593 | Comparative Example |
| 6 | 0.016 | 9.41 | 0.110 | 0.0023 | 0.0011 | 0.0049 | — | — | 1.574 | Comparative Example |
| 7 | 0.011 | 3.20 | 0.003 | 0.0020 | 0.0016 | 0.0047 | 0.0038 | — | 1.566 | Comparative Example |
| 8 | 0.087 | 4.59 | 1.090 | 0.0027 | 0.0008 | 0.0041 | — | — | 1.603 | Comparative Example |
| 9 | 0.066 | 3.87 | 0.080 | 0.0148 | 0.0013 | 0.0057 | 0.0079 | — | 1.797 | Comparative Example |
| 10 | 0.050 | 3.21 | 0.160 | 0.0027 | 0.0067 | 0.0059 | 0.0080 | — | 1.767 | Comparative Example |
| 11 | 0.031 | 3.36 | 0.220 | 0.0087 | 0.0046 | 0.0108 | — | — | 1.843 | Comparative Example |
| 12 | 0.023 | 3.87 | 0.070 | 0.0024 | 0.0021 | 0.0077 | 0.0121 | — | 1.809 | Comparative Example |
| 13 | 0.016 | 3.16 | 0.130 | 0.0030 | 0.0018 | 0.0067 | 0.0046 | Cr: 0.18, Cu: 0.13, P: 0.006, Sn: 0.12, Mo: 0.005 | 1.936 | Example |
| 14 | 0.013 | 3.29 | 0.070 | 0.0018 | 0.0024 | 0.0035 | — | Cr: 0.05, Cu: 0.08, Sb: 0.04, Mo: 0.01 | 1.941 | Example |
| 15 | 0.049 | 5.12 | 0.160 | 0.0023 | 0.0027 | 0.0014 | 0.0092 | Cu: 0.34, Ni: 0.003, Sn: 0.36, B: 0.0023, Nb: 0.0018 | 1.931 | Example |
| 16 | 0.042 | 3.41 | 0.060 | 0.0074 | 0.0039 | 0.0018 | — | Cr: 0.05, Cu: 0.10, P: 0.07, Sb: 0.05, Mo: 0.02 | 1.939 | Example |
| 17 | 0.021 | 3.20 | 0.440 | 0.0025 | 0.0011 | 0.0033 | 0.0051 | Cu: 0.02, Sb: 0.43, Bi: 0.007, Mo: 0.09, V: 0.002 | 1.941 | Example |
| 18 | 0.074 | 2.41 | 0.150 | 0.0027 | 0.0018 | 0.0088 | — | P: 0.45, Sb: 0.007, Bi: 0.03, Nb: 0.009, V: 0.009 | 1.935 | Example |
| 19 | 0.026 | 3.18 | 0.080 | 0.0023 | 0.0021 | 0.0071 | 0.0023 | Cr: 0.01, Ni: 0.47, Sn: 0.006, Bi: 0.48, B: 0.0002 | 1.940 | Example |

* The balance is Fe and inevitable impurities

Example 3

Molten steel was prepared having a chemical composition consisting of, in mass %,

C: 0.025%,

Si: 3.27%,

Mn: 0.084%, sol.Al: 0.0044%,

N: 0.0031%,

S: 0.0027%,

Sn: 0.051%,

Cr: 0.055% with the balance consisting of Fe and inevitable impurities. The Se content in the molten steel was smaller than the detection limit. From the molten steel, a slab with a thickness of 50 mm was manufactured by continuous casting.

The obtained slab was heated at 1200° C. for 100 seconds. The slab was heated using a tunnel furnace of the regenerative burner heating type. A slab conveyance rate in a heating process in the tunnel furnace was 60 m/min.

100 seconds after completion of the heating treatment, hot rolling was started to obtain hot-rolled steel sheets with a thickness of 2.8 mm. The obtained hot-rolled steel sheets were then subjected to hot band annealing under the conditions as listed in Table 3. In the hot band annealing, the soaking temperature was 1000° C. and the soaking time was 60 seconds.

The hot-rolled steel sheets after hot band annealing were then subjected to cold rolling. In Table 3, the thickness of samples No. 1, 5, 6, and 7 was reduced to 0.27 mm, which was equal to a product thickness, by one rolling operation. The thickness of samples No. 2, 3, 4, 8, 9, and 10 was reduced to 0.27 mm, which was equal to a final sheet thickness, by two rolling operations with intermediate annealing performed therebetween. Specifically, first, the samples were subjected to first cold rolling into a thickness of 1.6 mm, and then subjected to intermediate annealing under conditions as listed in Table 3. In the intermediate annealing, the soaking temperature was 1000° C. and the soaking time was 60 seconds. Subsequently, the samples were subjected to second cold rolling into a final sheet thickness of 0.27 mm.

Then, the obtained cold-rolled steel sheets were subjected to primary recrystallization annealing, which also served as decarburization annealing. In the primary recrystallization annealing, the soaking temperature was 820° C. and the soaking time was 150 seconds. The primary recrystallization annealing was performed in an atmosphere of 60% $H_2$+40% $N_2$ with a dew point of 54° C.

Then, the steel sheets after the primary recrystallization annealing were applied, on their surfaces, with an annealing separator mainly containing MgO, and then subjected to secondary recrystallization annealing, which also served as purification annealing. In the secondary recrystallization annealing, the steel sheets were retained at 1200° C. for 10 hours in a $H_2$ atmosphere.

Subsequently, the steel sheets were applied, on their surfaces, with a treatment solution for tension-applying coating, and then subjected to flattening annealing, which also served as baking of the tension-applying coating, to form a tension-applying coating mainly containing magnesium phosphate and chromic acid. The flattening annealing was performed at 840° C. for 30 seconds.

The magnetic flux density $B_8$ of the obtained grain-oriented electrical steel sheets was measured by the method described in JIS C2550. The measurement results were presented in Table 3. As is apparent from the results listed in Table 3, the steel sheets satisfying the conditions according to the disclosure have excellent magnetic properties.

TABLE 3

| No. | Hot band annealing | Heating process in hot band annealing Time to reach 900° C. from 400° C. (s) | Intermediate annealing | Heating process in intermediate annealing Time to reach 900° C. from 400° C. (s) | Magnetic flux density $B_8$ (T) | Remarks |
|---|---|---|---|---|---|---|
| 1 | Not done | — | Not done | — | 1.887 | Comparative Example |
| 2 | Not done | — | Done | 10 | 1.934 | Example |
| 3 | Not done | — | Done | 50 | 1.932 | Example |
| 4 | Not done | — | Done | 90 | 1.931 | Example |
| 5 | Done | 10 | Not done | — | 1.937 | Example |
| 6 | Done | 50 | Not done | — | 1.934 | Example |
| 7 | Done | 90 | Not done | — | 1.933 | Example |
| 8 | Done | 10 | Done | 50 | 1.940 | Example |
| 9 | Done | 50 | Done | 50 | 1.941 | Example |
| 10 | Done | 90 | Done | 50 | 1.939 | Example |

INDUSTRIAL APPLICABILITY

According to the disclosure, a grain-oriented electrical steel sheet which is manufactured from a thin slab without using an inhibitor forming component can stably achieve excellent magnetic properties.

The invention claimed is:

1. A method for manufacturing a grain-oriented electrical steel sheet, comprising:

subjecting molten steel to continuous casting to form a slab with a thickness of 25 mm or more and 100 mm or less, the molten steel having a chemical composition containing, in mass %, C: 0.002% or more and 0.100% or less, Si: 2.00% or more and 8.00% or less, Mn: 0.005% or more and 1.000% or less, sol.Al: less than 0.0100%, N: less than 0.0060%, S: less than 0.0100%, and Se: less than 0.0100%, with the balance being Fe and inevitable impurities;

heating the slab in a tunnel furnace;

hot rolling the heated slab to obtain a hot-rolled steel sheet;

optionally hot band annealing the hot-rolled steel sheet;

subjecting the hot-rolled steel sheet to cold rolling to obtain a cold-rolled steel sheet with a final sheet thickness;

subjecting the cold-rolled steel sheet to primary recrystallization annealing; and subjecting the cold-rolled steel sheet after the primary recrystallization annealing to secondary recrystallization annealing, wherein in the heating of the slab, the slab is heated while being conveyed along a casting direction at a rate of 10 m/min or more, a heating temperature is 1000° C. or more and 1300° C. or less and a heating time is 60 seconds or more and 600 seconds or less, and a time from completion of the slab heating to start of the hot rolling is 100 seconds or less, wherein (i) when the hot band annealing is performed, a time to reach 900° C. from 400° C. in a heating process of the hot band annealing is 100 seconds or less, and a soaking temperature in the hot band annealing is 950° C. or more, and wherein (ii) when the hot band annealing is not performed, the cold rolling has two or more rolling operations with intermediate annealing performed therebetween, a time to reach 900° C. from 400° C. in a heating process of the first intermediate annealing is 100 seconds or less, and a soaking temperature in the first intermediate annealing is 950° C. or more.

2. The method for manufacturing a grain-oriented electrical steel sheet according to claim 1, wherein the chemical composition contains, in mass %, S: less than 0.0030%, and Se: less than 0.0030%.

3. The method for manufacturing a grain-oriented electrical steel sheet according to claim 2, wherein the chemical composition further contains, in mass %, one or more selected from the group consisting of Cr: 0.01% or more and 0.50% or less, Cu: 0.01% or more and 0.50% or less, P: 0.005% or more and 0.50% or less, Ni: 0.001% or more and 0.50% or less, Sb: 0.005% or more and 0.50% or less, Sn: 0.005% or more and 0.50% or less, Bi: 0.005% or more and 0.50% or less, Mo: 0.005% or more and 0.100% or less, B: 0.0002% or more and 0.0025% or less, Nb: 0.0010% or more and 0.0100% or less, and V: 0.0010% or more and 0.0100% or less.

4. The method for manufacturing a grain-oriented electrical steel sheet according to claim 3, wherein the heating of the slab is at least partially performed by induction heating.

5. The method for manufacturing a grain-oriented electrical steel sheet according to claim 2, wherein the heating of the slab is at least partially performed by induction heating.

6. The method for manufacturing a grain-oriented electrical steel sheet according to claim 1, wherein the chemical composition further contains, in mass %, one or more selected from the group consisting of Cr: 0.01% or more and 0.50% or less, Cu: 0.01% or more and 0.50% or less, P: 0.005% or more and 0.50% or less, Ni: 0.001% or more and 0.50% or less, Sb: 0.005% or more and 0.50% or less, Sn: 0.005% or more and 0.50% or less, Bi: 0.005% or more and 0.50% or less, Mo: 0.005% or more and 0.100% or less, B: 0.0002% or more and 0.0025% or less, Nb: 0.0010% or more and 0.0100% or less, and V: 0.0010% or more and 0.0100% or less.

7. The method for manufacturing a grain-oriented electrical steel sheet according to claim 6, wherein the heating of the slab is at least partially performed by induction heating.

8. The method for manufacturing a grain-oriented electrical steel sheet according to claim 1, wherein the heating of the slab is at least partially performed by induction heating.

* * * * *